United States Patent [19]

Turner

[11] 4,327,788

[45] May 4, 1982

[54] PANEL DOOR AND METHOD OF CONSTRUCTION

[76] Inventor: Dana L. Turner, 2701 McGee Dr., Norman, Okla. 73069

[21] Appl. No.: 139,447

[22] Filed: Apr. 11, 1980

[51] Int. Cl.[3] ..... B27F 7/00

[52] U.S. Cl. ..... 144/319; 52/316

[58] Field of Search ..... 52/455, 316, 813, 811, 52/822, 716, 311; D25/80, 48; 144/309 N, 314 A, 319

[56] References Cited

U.S. PATENT DOCUMENTS

| | | | |
|---|---|---|---|
| 293,158 | 2/1884 | Freschl . | |
| 473,185 | 4/1892 | Cameron . | |
| 1,988,236 | 1/1935 | Chatfield . | |
| 2,705,820 | 4/1955 | Torrence | 52/822 X |
| 3,308,592 | 3/1967 | Miller, Jr. | 52/455 |
| 3,365,854 | 1/1968 | Gallo | 52/716 |
| 3,375,031 | 3/1968 | Dargene | D25/48 X |
| 3,731,443 | 5/1973 | Zaroor | 52/309 |
| 3,829,337 | 8/1974 | Cheng | 156/63 |
| 4,008,551 | 2/1977 | MacDonald et al. | 52/316 |
| 4,083,160 | 4/1978 | MacDonald et al. | 52/316 |

*Primary Examiner*—Carl D. Friedman

*Attorney, Agent, or Firm*—Hubbard, Thurman, Turner, Tucker & Glaser

[57] ABSTRACT

A raised panel door for use on kitchen and vanity cabinets and the like which can be quickly and inexpensively constructed from a conventional laminated door having a core and a thin veneer facing. First, an outer molding is secured around the periphery of the laminated panel to provide a finished edge and to conceal the exposed edges of the veneer facing the core. Then, using the outer molding as a guide a rectangular groove is cut through the veneer and into the core. Finally, an inner molding adapted to fit in the groove and having a pair of opposing lips to conceal the upper edges of the groove is glued in place to complete the door.

7 Claims, 3 Drawing Figures

PANEL DOOR AND METHOD OF CONSTRUCTION

BACKGROUND OF THE INVENTION

This invention generally relates to door construction and more particularly to a raised panel door constructed from a conventional laminated door panel for use with kitchen and vanity cabinets and the like.

Laminated wood panels are widely used for full-sized doors, cabinet doors, wall panels and a variety of other uses in both residential and commercial construction. They are made using mass production techniques and are much less expensive than those made by traditional carpentry methods. Further, the panels are significantly lighter in weight than earlier doors and panels. Normally, the laminated panels have a core made of inexpensive wood, chipboard or particle board which may be solid or hollow. The hollow core has solid portions which form the edges of the door and extend through it at various points to provide adequate rigidity. The core is bonded between a pair of relatively thin veneer sheets which form the outer front and rear surfaces of the door and provide a finished appearance. Normally, the veneer sheets are made of wood or a plastic material such as that sold under the trademark "Formica".

One of the primary drawbacks of such door panels is their plain and inexpensive appearance. Generally, it is not possible to mill decorative patterns into the surface of the doors because such milling would expose the unfinished core material and would require additional expensive finishing treatments to produce a satisfactory product. Attempts have also been made to give the panels a raised appearance by simply gluing moldings and other decorative pieces to the surface of the veneer, but the results have generally been unsatisfactory.

Accordingly, it is an object of this invention to provide a new, improved and inexpensive method to construct a raised panel door having an attractive and well made appearance from a conventional laminated door panel.

It is another object of this invention to provide a method for constructing a raised panel door from a conventional laminated door panel using simply shaped moldings, uncomplicated techniques and simple tools.

It is a further object of this invention to provide for a raised panel door having a core, a veneer facing, and inner and outer moldings, which provide a raised appearance and conceal all exposed portions of the core material.

SUMMARY OF THE INVENTION

This invention can be most broadly summarized as providing a new and improved method for constructing a raised panel door from a conventional laminated door panel having a core and a thin veneer facing which includes the steps of securing an outer molding to the sides of the panel to conceal exposed ends of the core, cutting a groove through the veneer facing into the core using the outer molding as a guide and then installing an inner molding in the groove which has a pair of opposing lips for concealing the upper edges of the groove.

This invention can also be summarized as providing for a raised panel door which includes a laminated panel having a core and a relatively thin veneer facing bonded to the outer surface of the core and also having a groove extending through the veneer facing into the core, an inner molding secured in the groove which has a lower portion adapted to fit into the groove and an upper portion extending above the veneer facing an including a lip which overlays the facing for concealing the upper edge of the groove, and an outer molding secured to a side of the panel which has a lower portion for concealing an end of the core and an upper portion extending above the veneer facing and including a lip which overlays the veneer facing for concealing its edge.

In accordance with the more detailed aspect of this invention the upper portion of the outer molding has an additional opposing lip which also overlays the facing for concealing a second upper edge of the groove.

In accordance with another detailed aspect of this invention the groove has a plurality of interconnecting segments, each of which is parallel to and spaced a predetermined distance from the associated edge of the laminated panel.

DESCRIPTION OF THE PREFERRED EMBODIMENT

Figure 1:
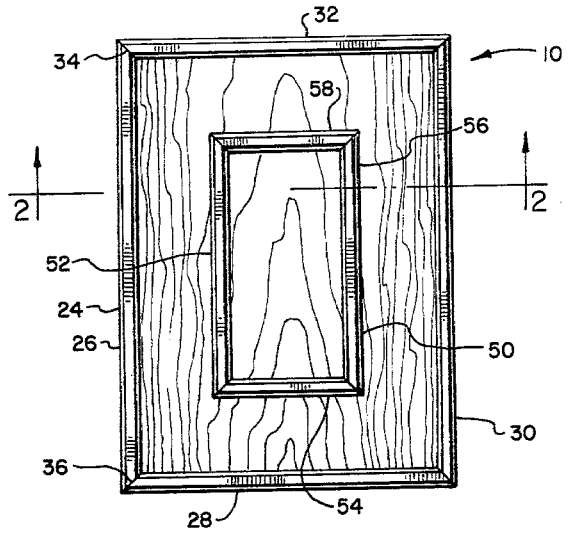
FIG. 1 is a front view of a raised panel door in accordance with the present invention.
Figure 2:
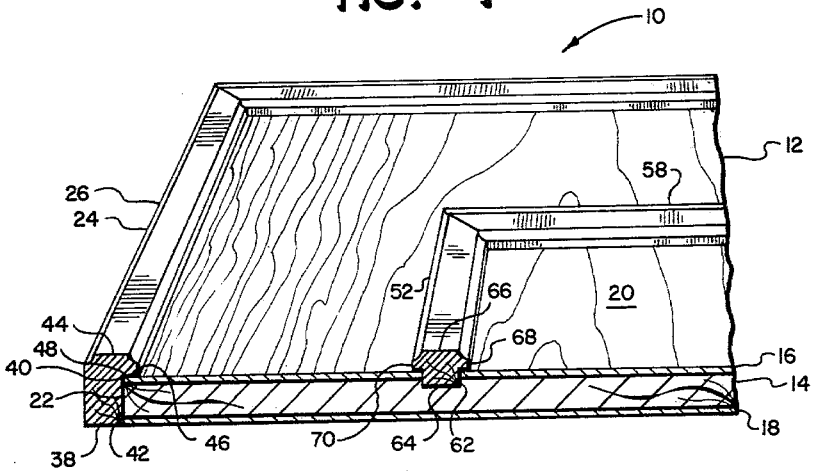
FIG. 2 is a perspective view of a section of the raised panel door taken at 2—2 of FIG. 1, partially broken away.
Figure 3:
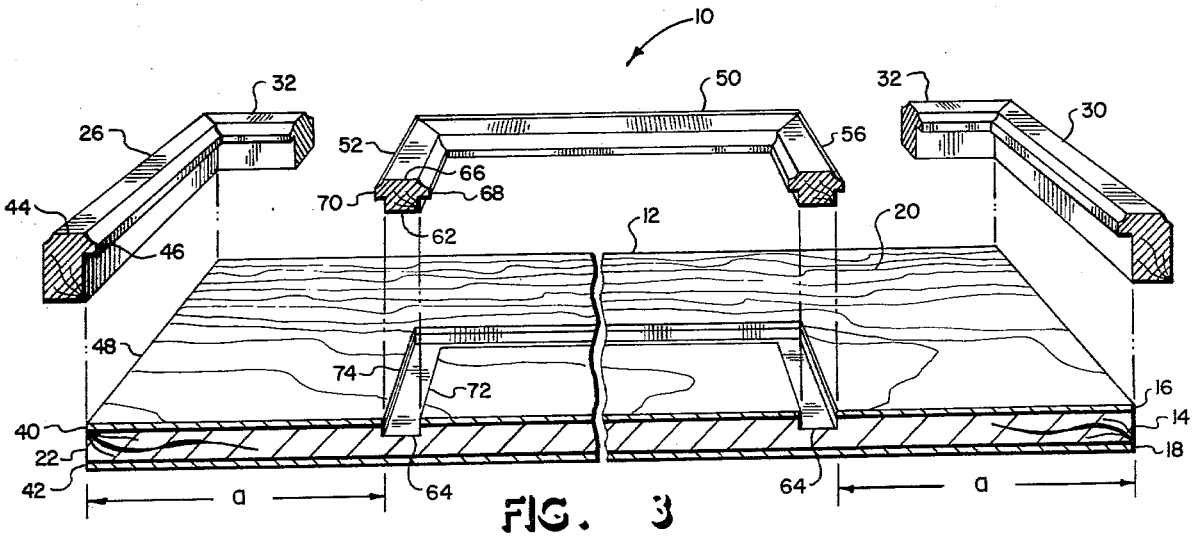
FIG.3 is an exploded perspective view of a portion of the door of FIG. 1.

The novel features believed characteristic of this invention are set forth in the appended claims. The invention itself, however, may be best understood and its various objects and advantages best appreciated by reference to the detailed description below in connection with the accompanying drawings. FIGS. 1–3 illustrate a raised panel door constructed in accordance with the present invention and generally designated by the numeral 10. The door is constructed from a laminated panel 12 which has a central core 14. The core is preferably solid and is constructed from pieces of scrap wood which have been bonded edge to edge with an appropriate adhesive, but various other materials, such as particle board or chip board might also be used a core material. The core is preferably sold throughout, but might contain appropriately positioned voids, if desired, to lower the weight and cost of the core.

The core is bonded between two relatively thin pieces of veneer 16 and 18 which form the front and rear faces, respectively, of the panel. In the preferred embodiment shown the veneer is made of wood which has been finished on its outer surface 20 with a clear protective coating to expose the natural grain of the wood, but a variety of other suitable materials may be used. For example, a plastic veneer similar to the material sold under the trademark "Formica" may be used to provide a more durable, washable and scratch-resistant surface where desired.

In order to give the edges of the door a finished appearance and to conceal the exposed ends 22 of the core, outer molding generally designated by the number 24 has been installed around the periphery of the panel. The molding has four segments 26, 28, 30 and 32, each of which is preferably a milled section of solid wood which has been beveled at its ends (typically as ends 34 and 36 are) to mate with the adjoining segments. Referring to FIG. 2 it can be seen that molding segment 26, which is typical in cross-section, has a lower portion 38 which conceals core end 22 as well as sides 40 and 42 of veneer facings 16 and 18, respectively. Segment 26 also has an upper portion 44 which extends above outer surface 20 of the facing so as to provide a raised panel appearance.

Upper portion 44 also includes lip 46, an important aspect of this invention which overlays outer surface 20 so as to conceal edge 48 of the veneer. Concealment of this particular edge of the veneer is important and desirable because it is normally somewhat rough and irregular and if left exposed it would significantly detract from the finished appearance of the door. Similar lips on the other outer molding segments cooperate with lip 46 to cover this edge around the entire periphery of the outer surface.

Mounted in the central portion of the panel is an inner molding generally designated by the number 50 which has four segments 52, 54, 56 and 60 mounted in a rectangular arrangement. As with the outer molding, the inner molding segments are identical in cross-section and are beveled at their ends where they are joined. Referring to FIGS. 2 and 3, it can be seen in cross-section typical segment 52 has a lower portion 62 which is generally rectangular and is adapted to fit into groove 64 which has been cut in the laminated panel. The segment also has an upper portion 66 which has been milled into a shape which compliments the upper portion of the outer molding. Upper portion 66 also contains two opposing lips 68 and 70 which overlay outer surface 20 of the veneer facing and which function to conceal upper edges 72 and 74, respectively, of the groove.

Groove 64, which is rectangular in cross-section, is sized slightly larger than lower portion 62 so as to permit some lateral adjustment of the inner molding during assembly to compensate for slight variations in the molding sizes. The purpose of the groove is to permit rapid alignment of the molding segments during assembly and to provide a secure glue joint that will not easily loosen. For ease of construction each of the sides or segments of the groove is spaced the same distance from the nearest parallel edge of a laminated panel. For example, in the embodiment illustrated each of the four segments of the groove is spaced a fixed distance "a" from the nearest respective parallel edge of the panel. Although the groove is preferably rectangular in cross-section a variety of other goove configurations such as triangular or trapezoidal.

Another important aspect of this invention is the relative ease and speed with which the disclosed door panel can be constructed as compared to a raised panel door made according to traditional methods. Construction of the disclosed door can be accomplished with simple tools and can even be done at the jobsite if desired. The first step in making the door is to cut laminated panel 12 to the desired size. Next, exterior molding segments 26, 28, 30 and 32 are cut and mitered to the appropriate sizes and then glued and tacked in place around the periphery of the laminated panel as shown in FIG. 1. Next, groove 64 is cut in the panel, preferably with a portable router, using outer molding 24 as a guide. The groove so produced is accurately positioned in the central portion of the panel with each of its sides spaced an equal distance from the edge of the panel. Finally, inner molding segments 52, 54, 56 and 58 are cut and mitered to the desired lengths and are and tacked in place in the groove. The segments are automatically aligned by the groove and may be adjusted slightly before tacking to provide a good fit of the mitered joints.

Thus, it can be seen that the present invention provides for a novel raised panel door and a method for quickly and inexpensively constructing the door from a conventional laminated door panel. Although only one specific embodiment of this invention has been illustrated and described, it is to be understood that obvious modifications and changes can be made in it without departing from the true scope and spirit of the invention.

I claim:

1. A method for constructing a raised panel door from a conventional laminated door panel having a core and a relatively thin veneer facing comprising the steps of:

securing an outer molding to a side of the panel to conceal the exposed ends of the core and facing;

cutting a groove through said veneer facing and into said core using said outer molding as a guide;

installing an inner molding in said groove, said inner molding having a lip for concealing an upper edge of said groove.

2. The method of claim 1 further including the step of cutting said conventional door to a predetermined size.

3. The method of claim 1 wherein said inner and outer moldings extend above said veneer facing so as to provide a raised panel appearance.

4. The method of claim 1 wherein said outer molding extends around the entire periphery of said door.

5. The method of claim 1 wherein said groove has a plurality of interconnected segments, each segment being parallel to and spaced a predetermined distance from an associated edge of said door.

6. The method of claim 1 wherein said groove has a uniform rectangular cross-section.

7. A method for constructing a raised panel door from a conventional laminated door panel having a core and a substantially thin veneer facing comprising the steps of:

cutting said conventional door to a predetermined rectangular shape;

securing a plurality of mitered outer molding segments around the outer periphery of the door, each of said segments having a lower portion concealing associated exposed ends of said core and said veneer facing, and an upper portion extending above said facing and having a lip overlaying said facing for concealing an associated edge of said facing;

cutting a rectangular groove through said facing and partially through said core using said outer molding segments as a guide;

installing a plurality of mitered inner molding segments in said groove, each of said inner molding segments having a lower portion adapted fit in said groove and an upper portion extending above said veneer facing and having a pair of opposing lips overlaying said facing for concealing the upper edges of said groove.

* * * * *